US011030935B2

(12) United States Patent
Kim et al.

(10) Patent No.: US 11,030,935 B2
(45) Date of Patent: Jun. 8, 2021

(54) DISPLAY DEVICE AND METHOD OF DRIVING THE SAME

(71) Applicant: SAMSUNG DISPLAY CO., LTD., Yongin-si (KR)

(72) Inventors: Kyunho Kim, Hwaseong-si (KR); Minyoung Park, Busan (KR); Jongmin Shim, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/564,843

(22) Filed: Sep. 9, 2019

(65) Prior Publication Data

US 2020/0143733 A1 May 7, 2020

(30) Foreign Application Priority Data

Nov. 6, 2018 (KR) ..... 10-2018-0134946

(51) Int. Cl.
*G09G 3/20* (2006.01)

(52) U.S. Cl.
CPC ... *G09G 3/2018* (2013.01); *G09G 2300/0452* (2013.01); *G09G 2310/027* (2013.01); *G09G 2320/0238* (2013.01)

(58) Field of Classification Search
None
See application file for complete search history.

(56) References Cited

U.S. PATENT DOCUMENTS

2013/0057568 A1* 3/2013 Liao ..... G09G 3/3648 345/589
2015/0356903 A1* 12/2015 Lee ..... G06K 9/2063 345/600

FOREIGN PATENT DOCUMENTS

| | | |
|---|---|---|
| KR | 10-0956344 | 4/2010 |
| KR | 10-1749752 | 6/2017 |
| KR | 10-1769732 | 8/2017 |
| KR | 10-2017-0136112 | 12/2017 |

* cited by examiner

*Primary Examiner* — Carl Adams
(74) *Attorney, Agent, or Firm* — F. Chau & Associates, LLC

(57) ABSTRACT

A display device includes a display panel including a plurality of data lines and a plurality of color pixels arranged into rows, a black-grayscale correcting circuit, and a data driving circuit. The black-grayscale circuit corrects a black-level of black-grayscale data of input grayscale data to generate corrected image data. The black-grayscale circuit corrects the black-grayscale data to be applied to a current one of the rows during a current horizontal period based on the input grayscale data to be applied to a previous one of the rows during a previous horizontal period and the input grayscale data to be applied to a next one of the rows during a next horizontal period. The data driving circuit converts the corrected image data into data voltages for output to the data lines.

23 Claims, 10 Drawing Sheets

FIG. 3B

<CENTER>

| | R | G | B |
|---|---|---|---|
| BLACK LIMIT | 3.61 | 3.45 | 4.11 |
| BLACK SET | 3.31 | 3.15 | 3.81 |

331

RISING

| D(n+1) | 50 | 150 | 255 | |
|---|---|---|---|---|
| BLACK LEV | 3.36 | 3.41 | 3.46 | R |
| | 3.2 | 3.25 | 3.3 | G |
| | 3.86 | 3.91 | 3.96 | B |

RC_T1

FALLING

| D(n-1) | 50 | 150 | 255 | |
|---|---|---|---|---|
| BLACK LEV | 3.26 | 3.21 | 3.16 | R |
| | 3.1 | 3.05 | 3 | G |
| | 3.76 | 3.71 | 3.66 | B |

FC_T1

FIG. 3C

<RIGHT>

332

RISING CENTER REFERENCE +0.01

| D(n+1) | 50 | 150 | 255 | |
|---|---|---|---|---|
| BLACK LEV | 3.37 | 3.42 | 3.47 | R |
| | 3.21 | 3.26 | 3.31 | G |
| | 3.87 | 3.92 | 3.97 | B |

RC_T2

FALLING CENTER REFERENCE -0.01

| D(n-1) | 50 | 150 | 255 | |
|---|---|---|---|---|
| BLACK LEV | 3.25 | 3.2 | 3.15 | R |
| | 3.09 | 3.04 | 2.99 | G |
| | 3.75 | 3.7 | 3.65 | B |

FC_T2

FIG 3D

333

<LEFT>

RISING CENTER REFERENCE -0.01

| D(n+1) | 50 | 150 | 255 | |
|---|---|---|---|---|
| BLACK LEV | 3.35 | 3.4 | 3.45 | R |
| | 3.19 | 3.24 | 3.29 | G |
| | 3.85 | 3.9 | 3.95 | B |

RC_T3

FALLING CENTER REFERENCE -0.02

| D(n-1) | 50 | 150 | 255 | |
|---|---|---|---|---|
| BLACK LEV | 3.24 | 3.19 | 3.14 | R |
| | 3.08 | 3.03 | 2.98 | G |
| | 3.74 | 3.69 | 3.64 | B |

FC_T3

<NOR_I>

DISPLAY DEVICE AND METHOD OF DRIVING THE SAME

CROSS-REFERENCE TO RELATED APPLICATION

This U.S. non-provisional application claims the benefit of and priority under 35 U.S.C. 119 to Korean Patent Application No. 10-2018-0134946 filed on Nov. 6, 2018, the disclosure of which is incorporated by reference in its entirety herein.

BACKGROUND

1. Technical Field

Exemplary embodiments of the inventive concept relate to a display device and a method of driving the display device. More particularly, exemplary embodiments of the inventive concept relate to a display device having an improved display quality and a method of driving the display device.

2. Discussion of Related Art

Flat panel display devices include a liquid crystal display (LCD) device and an organic light emitting display (OLED) device.

The liquid crystal display device includes a liquid crystal display panel displaying an image using light transmittance of liquid crystals, and a backlight assembly disposed under the liquid crystal display panel to provide light to the liquid crystal display panel.

The organic light emitting display device displays an image using organic light emitting diodes that emit light by recombination of electrons and holes. Such an organic light emitting display device is more widely used because it has a fast response time and has a low power consumption.

In the case of the organic light emitting display device, the luminance of the black-gray scale is about 0 nit and the luminance of the black-level of the liquid crystal display device is about 0.001 nit to about 0.01 nit. The contrast ratio has the advantage that the organic light emitting display device can be made larger than the liquid crystal display device. On the other hand, black-level optimization tuning in the organic light emitting display device requires very precise tuners, which may be difficult to manufacture.

BRIEF SUMMARY OF THE INVENTION

Exemplary embodiments of the inventive concept provide a display device having improved luminance and capable of display images with improved quality.

Exemplary embodiments of the inventive concept provide a method of driving the display device.

According to an exemplary embodiment of the inventive concept, there is provided a display device including a display panel including a plurality of data lines and a plurality of color pixels arranged into rows, a black-grayscale correcting circuit, and a data driving circuit. The black-grayscale correcting circuit corrects a black-level of black-grayscale data of input grayscale data to generate corrected image data. The black-grayscale circuit corrects the black-grayscale data to be applied to a current one of the rows during a current horizontal period based on the input grayscale data to be applied to a previous one of the rows based on grayscale data during a previous horizontal period and the input grayscale data to be applied to a next one of the rows during a next horizontal period. The data driving circuit converts the corrected image data into data voltages for output to the data lines.

In an exemplary embodiment, when input image data includes a pattern in which specific-grayscale data (e.g., non-black) and the black-grayscale data alternate by a horizontal period, the black-grayscale correcting circuit differently corrects the black-level of the black-grayscale data according to a color of the pixels to receive the input grayscale data.

In an exemplary embodiment, when the input grayscale data include consecutive black-grayscale data in a plurality of horizontal periods, the black-grayscale correcting circuit may correct the black-level of the black-grayscale data to about 0 V.

In an exemplary embodiment, a black-level of the black-grayscale data corresponding to first and last horizontal periods of the plurality of horizontal periods corresponding to the consecutive black-grayscale data is differently corrected according to a color of the pixels to receive the input grayscale data.

In an exemplary embodiment, the black-grayscale correcting circuit corrects a black-level of the black-grayscale data according to an area of the display panel where a color pixel corresponding to the black-grayscale data is located.

In an exemplary embodiment, when the grayscale data of the previous horizontal period corresponding to the black-grayscale data is middle grayscale data with respect to a central area of the display panel, the black-grayscale correcting circuit corrects a black-level of the black-grayscale data to a black-level lower than a reference black-level.

In an exemplary embodiment, when the grayscale data of the next horizontal period corresponding to the black-grayscale data is middle grayscale data with respect to a central area of the display panel, the black-grayscale correcting circuit corrects a black-level of the black-grayscale data to a black-level higher than the reference black-level.

In an exemplary embodiment, the black-level correcting circuit corrects a black level of the black-grayscale data by increasing or decreasing based on the black level of the central area with respect to a left area and a right area of the central area.

In an exemplary embodiment, the black-grayscale correcting circuit sequentially corrects a black-level of the black-grayscale data to a first black-level determined by the grayscale data of the previous horizontal period and a second black-level determined by the grayscale data of the next horizontal period.

In an exemplary embodiment, the black-grayscale correcting circuit corrects a black-level of the black-grayscale data to an average level of a first black-level determined by the grayscale data of the previous horizontal period and a second black-level determined by the grayscale data of the next horizontal period.

According to an exemplary embodiment of the inventive concept, there is provided a method of driving a display device which includes a display panel including a plurality of data lines and a plurality of color pixels arranged into rows. The method includes correcting a black-level of black-grayscale data of input grayscale data to generate corrected image data, wherein the correcting corrects the black-grayscale data to be applied to a current one of rows during a current horizontal period based on the input grayscale data to be applied to a previous one of the rows during a previous horizontal period and the input grayscale data to be applied to a next one of the rows during a next horizontal period, converting the corrected image data into data voltages, and outputting the data voltages to the plurality of data lines.

In an exemplary embodiment, the correcting includes differently correcting the black-level of the black-grayscale data according to a color of the pixels to receive the input grayscale data, when the input grayscale data includes a pattern in which specific-grayscale data (e.g., non-black) and the black-grayscale data alternate by a horizontal period.

In an exemplary embodiment, the correcting includes correcting the black-level of the black-grayscale data to about 0 V, when the input grayscale data includes consecutive black-grayscale data in a plurality of horizontal periods.

In an exemplary embodiment, a black-level of the black-grayscale data corresponding to first and last horizontal periods of the plurality of horizontal periods corresponding to the consecutive black-grayscale data is differently corrected according to a color of the pixels to receive the input grayscale data.

In an exemplary embodiment, the correcting includes correcting a black-level of the black-grayscale data according to an area of the display panel where a color pixel corresponding to the black-grayscale data is located.

In an exemplary embodiment, the correcting includes correcting a black-level of the black-grayscale data to a black-level lower than a reference black-level, when grayscale data of the previous horizontal period corresponding to the black-grayscale data is middle grayscale data with respect to a central area of the display panel.

In an exemplary embodiment, the correcting includes correcting a black-level of the black-grayscale data to a black-level higher than the reference black-level, when grayscale data of the next horizontal period corresponding to the black-grayscale data is middle grayscale data with respect to a central area of the display panel.

In an exemplary embodiment, the correcting further includes correcting a black level of the black-grayscale data by increasing or decreasing based on the black level of the central area with respect to a left area and a right area of the central area.

In an exemplary embodiment, the correcting further includes sequentially correcting a black-level of the black-grayscale data to a first black-level determined by the grayscale data of the previous horizontal period and a second black-level determined by the grayscale data of the next horizontal period.

In an exemplary embodiment, the correcting further includes correcting a black-level of the black-grayscale data to an average level of the a first black-level determined by the grayscale data of the previous horizontal period and a second black-level determined by the grayscale data of the next horizontal period.

According to an exemplary embodiment of the inventive concept, there is provided a display device including a display panel, a correction circuit, and a data driving circuit. The display panel includes a plurality of color pixels arranged into rows and columns, the color pixels comprising a column of red pixels connected to a first data line, a column of green pixels connected to a second data line, and a column of blue pixels connected to a third data lines. The correction circuit corrects black grayscale data of input grayscale data for the red pixels to a red black-level, corrects black grayscale data of the input grayscale data for the green pixels to a green black-level, and corrects black grayscale data of the input grayscale data for the blue pixels to a blue black-level, to generated corrected image data. The data driving circuit converts the corrected image data into data voltages for output to the data lines. The red black-level is between the green and blue black-levels.

In an exemplary embodiment, the correction circuit performs the correction when the input grayscale data includes a pattern in which non-black grayscale data and the black grayscale data alternate by a horizontal period. The non-black grayscale data may be white grayscale data.

According to the exemplary embodiments, the luminance and the image quality may be improved by correcting the black-level of the black grayscale data differently according to color of a pixel, the position of the pixel on a display panel, the grayscale data of the previous horizontal period, and the grayscale data of the next horizontal period.

BRIEF DESCRIPTION OF THE DRAWINGS

The inventive concept will become more apparent by describing in detailed exemplary embodiments thereof with reference to the accompanying drawings, in which:

FIGS. 3A to 3D are conceptual diagrams illustrating a black-level look-up table according to an exemplary embodiment of the inventive concept;

DETAILED DESCRIPTION OF THE EXEMPLARY EMBODIMENTS

Hereinafter, exemplary embodiments of the inventive concept will be explained in detail with reference to the accompanying drawings.

Figure 1:
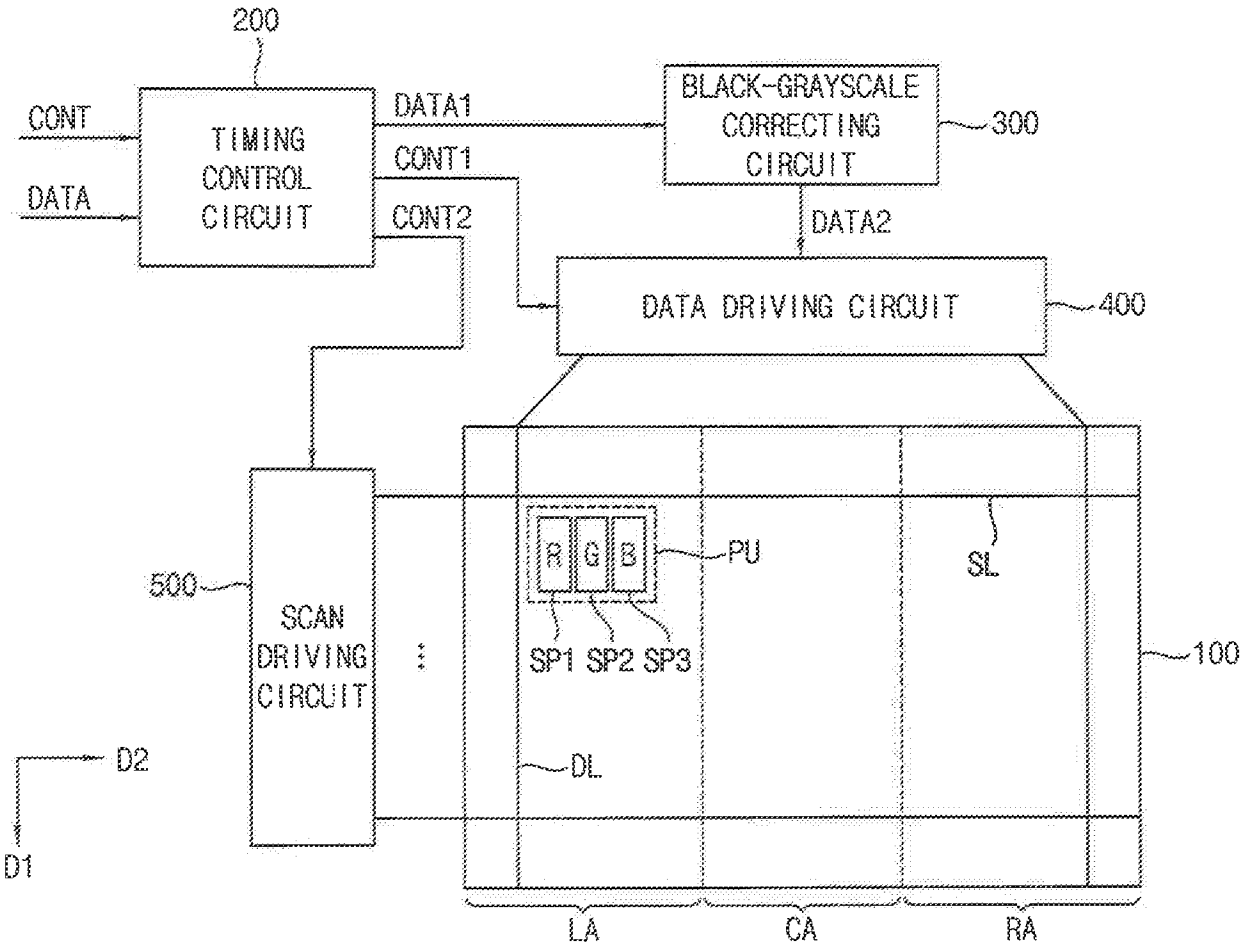
FIG. 1 is a block diagram illustrating a display device according to an exemplary embodiment of the inventive concept.

FIG. 1 is a block diagram illustrating a display device according to an exemplary embodiment of the inventive concept.

Referring to FIG. 1, the display device includes a display panel 100, a timing control circuit 200, a black-grayscale correcting circuit 300, a data driving circuit 400 (e.g., a data driver), and a scan driving circuit 500 (e.g., a gate driving circuit or a gate driver).

The data lines DL extend in a first direction D1 and are arranged in a second direction D2 crossing the first direction D1. The scan lines SL (e.g., gate lines) extend in the second direction D2 and are arranged in the first direction D1.

The pixel parts PU are arranged in a matrix type including a plurality of pixel rows and a plurality of pixel columns. Each of the pixel parts PU may include a plurality of color pixels SP1, SP2, and SP3. For example, the pixel part PU may include a red pixel SP1, a green pixel SP2, and a blue pixel SP3.

Each color pixel may include a switching transistor connected to a data line and a scan line, and a display element connected to the switching transistor. The display device may be an organic light emitting diode. Alternatively, the display element may be a liquid crystal capacitor.

The timing control circuit 200 may control an overall driving of the display device. The timing control circuit 200 may receive image data DATA and a control signal CONT from an external graphics device.

The timing control circuit 200 may correct the image data DATA using various correction algorithms. The timing control circuit 200 may convert the image data DATA into image data DATA1 having a format understood by the black-grayscale correcting circuit 300. The timing control circuit 200 transmits the image data DATA1 to the black-grayscale correcting circuit 300.

The timing control circuit 200 generates a plurality of control signals for driving the display panel 100 based on the control signal CONT. The plurality of control signals include a first control signal CONT1 for controlling the data driving circuit 400 and a second control signal CONT2 for controlling the scan driving circuit 500.

The black-grayscale correcting circuit 300 may correct black-grayscale data of the input image data to black-grayscale data of a black-level differently set according to a preset condition.

According to an exemplary embodiment of the inventive concept, when input image data includes a horizontal stripe pattern in which a specific-grayscale image and a black-grayscale image are alternately displayed by a horizontal period, the black-grayscale correcting circuit 300 corrects a black-level of the black-grayscale data corresponding to the black-grayscale image to an optimal reference color black-level set based on a dispersion by a color. For example, red black-grayscale data may be corrected to a reference red black-level, green black-grayscale data may be corrected to a reference green black-level, and blue black-grayscale data may be corrected to reference blue black-level. In an embodiment, red black-grayscale data is data that is scheduled to be applied to a red pixel so that a user perceives the red pixel as black, green black-grayscale data is data that is scheduled to be applied to a green pixel so that a user perceives the green pixel as black, and blue black-grayscale data is data that is scheduled to be applied to a blue pixel so that a user perceives the blue pixel as black. In an embodiment, the reference red black-level, the reference green black-level, and the reference blue black-level have different levels from each other. For example, a horizontal stripe pattern in which a specific-grayscale image (non-black) and a black-grayscale image are alternately displayed may include pairs of adjacent horizontal lines, where a first one of the lines of a pair has a black greyscale and the other line of the pair has a grayscale other than black. In an exemplary embodiment, the specific-grayscale image has a white grayscale such as 255 out of a grayscale ranging from 0 to 255, and the black-grayscale image has a black grayscale of 0. In alternate embodiment, the white grayscale is a range of values such as 250 to 255 and/or the black grayscale has a range of values such as 0 to 5. However, the specific-grayscale image is not limited to being a white image in alternate embodiments.

According to an exemplary embodiment of the inventive concept, when the input image data includes a black continuous pattern in which the black-grayscale image is continuously displayed for a plurality of horizontal lines, the black-grayscale correcting circuit 300 corrects the black-level of the black-grayscale data corresponding to the continuous black-grayscale image to 0 V. In addition, the black-level of the black-grayscale data corresponding to first and last horizontal periods of the plurality of horizontal periods having the continuous black-grayscale data is corrected to a reference color black-level considering color dispersion.

According to an exemplary embodiment of the inventive concept, when the input image data is a normal image that does not include a specific pattern such as the horizontal stripe pattern and the black continuous pattern, the black-grayscale correcting circuit 300 corrects the black-level of the black-grayscale data differently according to a color of a pixel, a position of the pixel on the display panel, and grayscale data of a previous horizontal line and a next horizontal line.

In an exemplary embodiment, the data driving circuit 400 converts the image data including the black-grayscale data corrected according to the condition in the black-grayscale correcting circuit 300 into a data voltage by using a gamma voltage in the black-grayscale correcting circuit 300 and outputs the data voltage to the data line DL.

The scan driving circuit 500 generates a plurality of scan signals (or gate signals) and sequentially outputs the scan signals to the scan lines SL of the display panel 100. The scan driving circuit 500 may be a shift register including a plurality of transistors directly integrated in a display panel.

Figure 2:
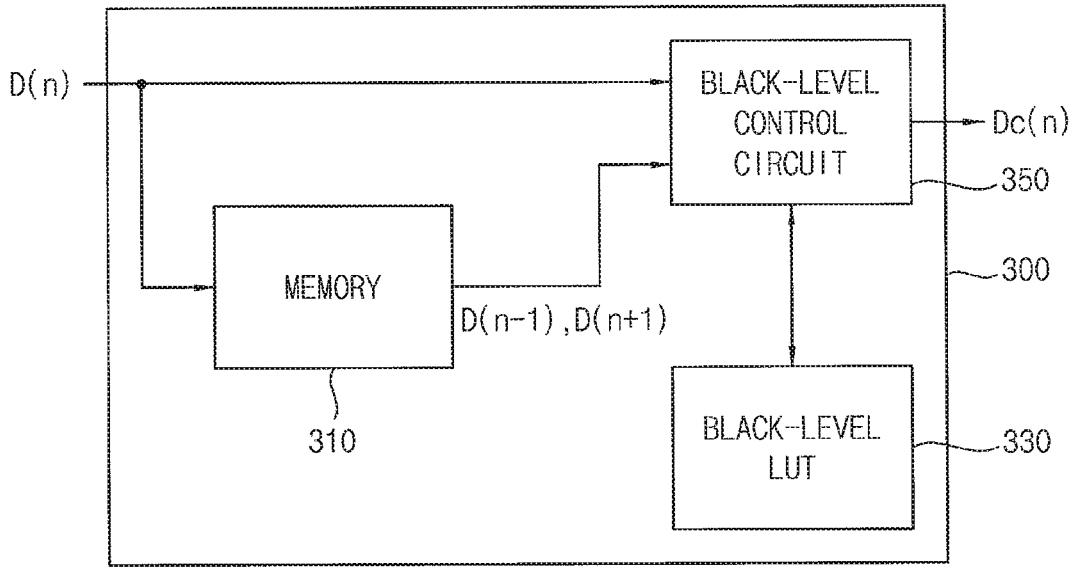
FIG. 2 is a block diagram illustrating a black-grayscale correcting circuit according to an exemplary embodiment of the inventive concept.

FIG. 2 is a block diagram illustrating a black-grayscale correcting circuit according to an exemplary embodiment of the inventive concept.

Referring to FIGS. 1 and 2, the black-grayscale correcting circuit 300 includes a memory 310, a black-level look-up table (LUT) 330, and a black-level control circuit 350.

The memory 310 may store the image data. The memory 310 may retain image data for an entire frame of the display panel 100, where the frame includes a number of horizontal lines (or rows). For example, first sub-data D(1) of the image data is applied to a first one the horizontal lines during a first horizontal period, second sub-data D(2) of the image data is applied to a second one of the horizontal lines during a second horizontal period after the first horizontal period, third sub-data D(3) of the image data is applied to a third one of the horizontal lines during a third horizontal period after the second horizontal period . . . , and n-th sub-data D(N) of the image data is applied to the n-th horizontal lines during an n-th horizontal period. Thus, when determining how to correct current image data to be applied to a current horizontal line, the black-level control circuit 350 is able to consider the current image data, previous image data that is to be applied to a prior horizontal line, and next image data that is to be applied to a next horizontal line.

In an exemplary embodiment of the inventive concept, the black-level look-up table 330 stores different black-levels according to the color of the black-grayscale data, a position of a pixel of the display panel, and the grayscale data of the previous and next horizontal lines.

For example, the black-level of black-grayscale data may have different levels depending on a red, a green, and a blue.

In addition, the black-level of the black-grayscale data for a current horizontal may have different levels according to the grayscale data of the previous horizontal line and the grayscale data of the next horizontal line. In an exemplary embodiment, when the image data of the previous horizontal line is middle grayscale data, the correction level of the black-grayscale data of the current horizontal line is lower than a reference black-level. In an exemplary embodiment, when the image data of the next horizontal line is the middle grayscale data, the correction level of the black-grayscale data of the current horizontal line is higher than the reference black-level. In an exemplary embodiment, middle grayscale data is between grayscale data representing black and grayscale data representing white.

The black-level of black-grayscale data may have different levels depending on a position of a pixel on a the display panel. For example, black-levels corresponding to left and right areas of a central area may be increased or decreased with respect to a black-level of black-grayscale data corresponding to a pixel located in the central area of the display panel.

The black-level control circuit 350 compares and analyzes grayscale data D(n−1) of a previous horizontal period and grayscale data D(n+1) of a next horizontal period with respect to grayscale data D(n) of a current horizontal period. When the input image data includes a horizontal stripe pattern, the black-level control circuit 350 corrects a black-level of the black-grayscale data to an optimal reference color black-level set based on the dispersion by the color using the black-level look-up table 330.

When the input image data includes the black continuous pattern in which the black-grayscale image is continuously displayed for the plurality of horizontal lines, the black-grayscale correcting circuit 300 corrects a black-level of the black-grayscale data corresponding to the continuous black-grayscale image to about 0 V using the black-level look-up table 330. The black-level of the black-grayscale data corresponding to the first and last horizontal periods of the plurality of horizontal periods having the continuous black-grayscale data is corrected to the reference color black-level based on the dispersion by the color.

When the input image data is normal image data (e.g., does not include a horizontal stripe pattern and does not include a black continuous pattern), the black-grayscale correcting circuit 300 corrects the black-level of the black-grayscale data differently according to the color, the position of a pixel of the display panel, and the grayscale data of the previous and next horizontal lines using the black-level look-up table 330.

The black-level control circuit 350 outputs a correction level Dc(n) of the black-gray scale data D(n) corresponding to a current horizontal line to the data driving circuit.

FIGS. 3A to 3D are conceptual diagrams illustrating a black-level look-up table according to an exemplary embodiment of the inventive concept.

The black-level look-up table 330 may include a first look-up table 331. The first look-up table 331 stores a reference red black-level, a reference green black-level, and a reference blue black-level.

Figure 3A:
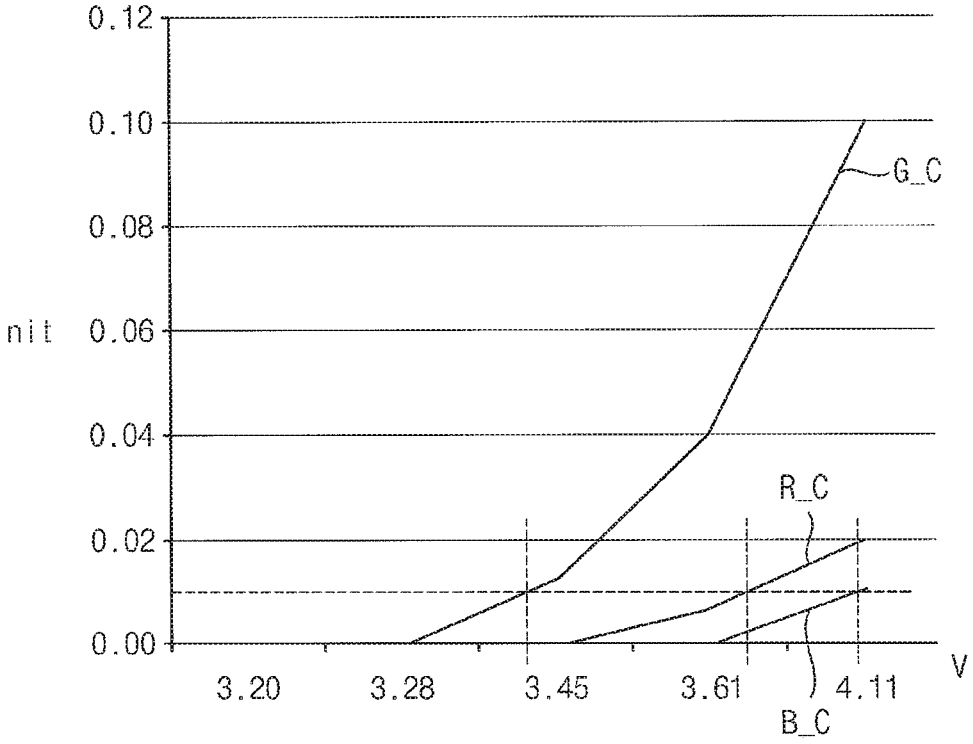

FIG. 3A is a graph showing a luminance of a color according to a voltage. Referring to FIG. 3A, a threshold luminance of about 0.01 nit representing the black-grayscale is at about 3.61 V of the red curve RC, about 3.45 V of the green curve GC and about 4.11 V of the blue curve BC. Therefore, the reference red black-level, the reference green black-level, and the reference blue black-level may be preset based on the luminance margin based on the threshold luminance.

Referring to FIG. 3B, the first look-up table 331 according to an exemplary embodiment stores the reference red black-level of about 3.31 V, the reference green black-level of about 3.15 V, and the reference blue black-level of about 3.81 V.

The first look-up table 331 stores black-levels corresponding to pixels located in the central area CA of the display panel. The first look-up table 331 may further include a first rising-color table RC_T1 and a first falling-color table FC_T1.

The first rising-color table RC_T1 stores a different correction level according to the grayscale data D(n+1) of the next horizontal line.

For example, as shown in FIG. 3B, when the grayscale data D(n+1) of the next horizontal line is red grayscale data of a 50-grayscale, the red black-level is about 3.36 V being higher than the reference red black-level of about 3.31 V. When the grayscale data D(n+1) of the next horizontal line is green grayscale data of the 50-grayscale, the green black-level is about 3.2 V being higher than the reference green black-level of about 3.15 V. When the grayscale data D(n+1) of the next horizontal line is blue grayscale data of the 50-grayscale, the blue black-level is about 3.86 V being higher than the reference blue black-level of about 3.81V.

When the grayscale data D(n+1) of the next horizontal line is red-grayscale data of a 150-grayscale, the red black-level is about 3.41 V being higher than about 3.36 V of the red black-grayscale level of the 50-grayscale. When the grayscale data D(n+1) of the next horizontal line is green grayscale data of the 150-grayscale, the green black-level is about 3.25 V being higher than about 3.2V of the green black-grayscale level of the 50-grayscale. When grayscale data D(n+1) of the next horizontal line is blue grayscale data of the 150-grayscale, the blue black-level is about 3.91 V being higher than about 3.86 V of the blue black-grayscale level of the 50-grayscale.

When the grayscale data D(n+1) of the next horizontal line is red grayscale data of a 255-grayscale, the red black-level is about 3.46 V being higher than about 3.41V of the red black-level of the 150-grayscale. When the grayscale data D(n+1) of the next horizontal line is green grayscale data of the 255-grayscale, the green black-level is about 3.3 V being higher than about 3.25 V of the green black-level of the 150-grayscale. When the grayscale data D(n+1) of the next horizontal line is blue grayscale data of the 255-grayscale, the blue black-level is about 3.96 V being higher than about 3.91 V of the blue black-level of the 150-grayscale.

The first falling-color table FC_T1 stores a different correction level according to the grayscale data D(n−1) of the previous horizontal line.

For example, as shown in FIG. 3B, when the grayscale data D(n−1) of the previous horizontal line is red grayscale data of the 50-grayscale, the red black-level is about 3.26 V being lower than about 3.31 V of the reference red black-level of the 50-grayscale. When the grayscale data D(n−1) of the previous horizontal line is green grayscale data of the 50-grayscale, the green black-level is about 3.1 V being lower than the 3.15 V of the reference green black-level of the 50-grayscale. When the grayscale data (D (n−1)) of the previous horizontal line is blue grayscale data of the 50-grayscale, the blue black-level is about 3.76 V being lower than the 3.81 V of the reference blue black-level of the 50-grayscale.

When the grayscale data D(n−1) of the previous horizontal line is red grayscale data of a 150-grayscale, the red black-level is about 3.21 V being lower than the 3.26 V of the red black-level of the 50-grayscale. When the grayscale data D(n−1) of the previous horizontal line is green grayscale data of the 150-grayscale, the green black-level is about 3.05 V being lower than the 3.1 V of the green black-level of the 50-grayscale. When the grayscale data D(n−1) of the previous horizontal line is blue grayscale data of the 150-grayscale, the blue black-level is about 3.71 V being higher than the 3.76 V of the blue black-level of the 50-grayscale.

When the grayscale data D(n−1) of the previous horizontal line is red grayscale data of a 255-grayscale, the red black-level is about 3.16 V being lower than the 3.21 V of the red black-level of the 150-grayscale. When the grayscale data D(n−1) of the previous horizontal line is green grayscale data of the 255-grayscale, the green black-level is about 3.0 V being higher than 3.05 V of the green black-level of the 150-grayscale. When the grayscale data D(n−1) of the previous horizontal line is blue grayscale data of the 255-grayscale, the blue black-level is about 3.66 V being higher than the 3.71 V of the blue black-level of the 150-grayscale.

Referring to FIGS. 1 and 3C, the black-level look-up table 330 includes a second look-up table 332. The second look-up table 332 stores the black-levels of the pixels located in the right area RA of the central area CA. For example, the right area RA is to the right of the central area CA.

The second look-up table 332 includes a second rising-color table RC_T2 and a second falling-color table FC_T2.

For example, referring to FIGS. 3B and 3C, the black-levels stored in the second rising-color table RC_T2 are increased by about 0.01 V from the black-levels stored in the first rising-color table RC_T1. The black-levels stored in the second falling-color table FC_T2 are reduced by about 0.01 from the black-level values stored in the first falling-color table FC_T1.

Referring to FIGS. 1 and 3D, the black-level look-up table 330 includes a third look-up table 333. The third look-up table 333 stores the black-level of the pixels located in the left area LA of the central area CA. For example, the left area LA is to the left of the central area CA.

The third look-up table 333 includes a third rising-color table RC_T3 and a third falling-color table FC_T3.

For example, referring to FIGS. 3B and 3D, the black-levels stored in the third rising-color table RC_T3 are reduced by about 0.01 V from the black-levels stored in the first rising-color table RC_T1. The black-levels stored in the third falling-color table FC_T3 are reduced by about 0.02 from the black-levels stored in the first falling-color table FC_T1.

Figure 4A:
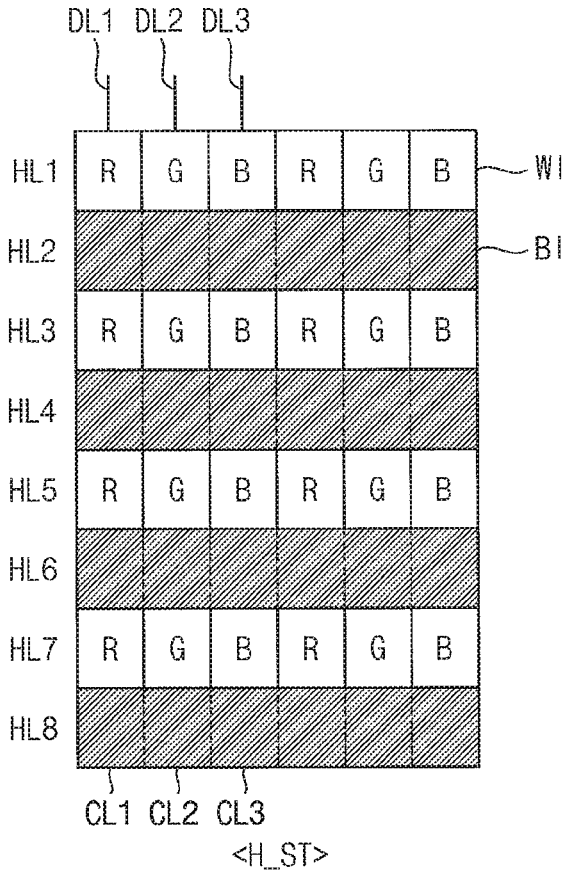
FIGS. 4A and 4B are a conceptual diagram and a waveform diagram illustrating a method of correcting a black-level of a horizontal stripe pattern according to an exemplary embodiment of the inventive concept.
Figure 4B:
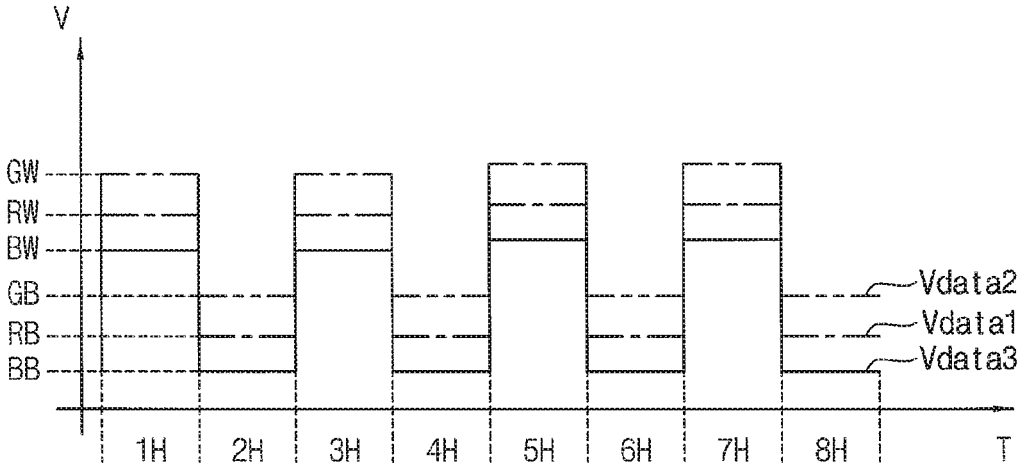

FIGS. 4A and 4B are a conceptual diagram and a waveform diagram illustrating a method of correcting a black-level of a horizontal stripe pattern according to an exemplary embodiment of the inventive concept.

FIG. 4A shows the horizontal stripe pattern H_ST displayed on the display panel. For example, the horizontal stripe pattern H_ST alternately repeats the white-grayscale image WI and the black-grayscale image BI by every horizontal period. That is, the image data of the horizontal stripe pattern H_ST has white grayscale data corresponding to the odd-numbered horizontal lines HL1, HL3, HL5 and HL7. The image data of the horizontal stripe pattern HST has black-grayscale data corresponding to even-numbered horizontal lines HL2, HL4, HL6 and HL8. In an exemplary embodiment, white grayscale data is a highest value from among a range of available grayscales. For example, if the range is between 0 and 255, the white grayscale data would be 255. In an alternate embodiment, the white grayscale data is a first sub-range of upper values of the range. For example, the first sub-range could be between 250 and 255. In an exemplary embodiment, black grayscale data is a lowest value from among a range of available grayscales. For example, the black grayscale data would be 0 if the range is between 0 and 255. In an alternate embodiment, the black grayscale data is a second sub-range of lower values of the range. For example, the second sub-range could be between 0 and 5.

Referring to FIGS. 3 and 4A, when the input image data satisfies the horizontal stripe pattern condition, the black-grayscale correcting circuit 300 corrects the black-level of the color black-grayscale data corresponding to the black-grayscale image BI to the reference color black-level set based on the dispersion by the color. For example, the black-grayscale correcting circuit 300 corrects the red black-grayscale data to the reference red black-level, corrects the green black-grayscale data to the reference green black-level, and corrects the blue black-grayscale data to the reference blue black-level using the black-level look-up table 330.

For example, referring to FIG. 4B, red pixels R are connected to a first data line DL 1, green pixels G are connected to a second data line DL 2, and blue pixels B are connected to a third data line DL3.

A red data voltage Vdata1 is applied to the first data line DL1, a green data voltage Vdata2 is applied to the second data line DL2, and a blue data voltage Vdata3 is applied to the third data line DL3.

Referring to the red data voltage Vdata1 shown in FIG. 4B, during the odd horizontal periods H1, H3, H5 and H7 corresponding to the odd-numbered horizontal lines HL1, HL3, HL5 and HL7, the first data line DL1 receives the data voltage of the red white level RW and during the even-numbered horizontal periods H2, H4, H6 and H8 corresponding to the even-numbered horizontal lines H2, H4, H6 and H8, the first data line DL1 receives the data voltage of the reference red black-level RB.

Referring to the green data voltage Vdata2 shown in FIG. 4B, during the odd horizontal periods 1H, 3H, 5H and 7H) corresponding to the odd-numbered horizontal lines HL1, HL3, HL5 and HL7, the second data line DL2 receives the data voltage of the green white level GW and during the even-numbered horizontal periods H2, H4, H6 and H8 corresponding to the even-numbered horizontal lines HL2, HL4, HL6 and HL8, the second data line DL2 receives the data voltage of the reference green black-level GB.

Referring to the blue data voltage Vdata3 shown in FIG. 4B, during the odd horizontal periods 1H, 3H, 5H and 7H corresponding to the odd-numbered horizontal lines HL1, HL3, HL5 and HL7, the third data line DL3 receives the data voltage of the blue white level BW and during even horizontal periods 2H, 4H, 6H and 8H corresponding to even-numbered horizontal lines HL2, HL4, HL6 and HL8, the third data line DL3 receives the data voltage of the reference blue black-level BB.

Figure 5A:
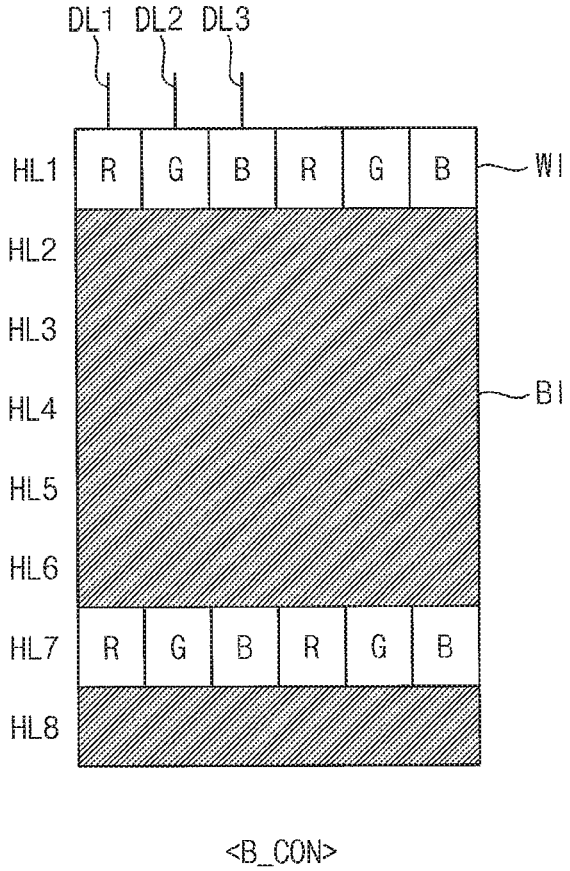
FIGS. 5A and 5B are a conceptual diagram and a waveform diagram illustrating a method of correcting a black-level of a black continuous pattern according to an exemplary embodiment of the inventive concept.
Figure 5B:
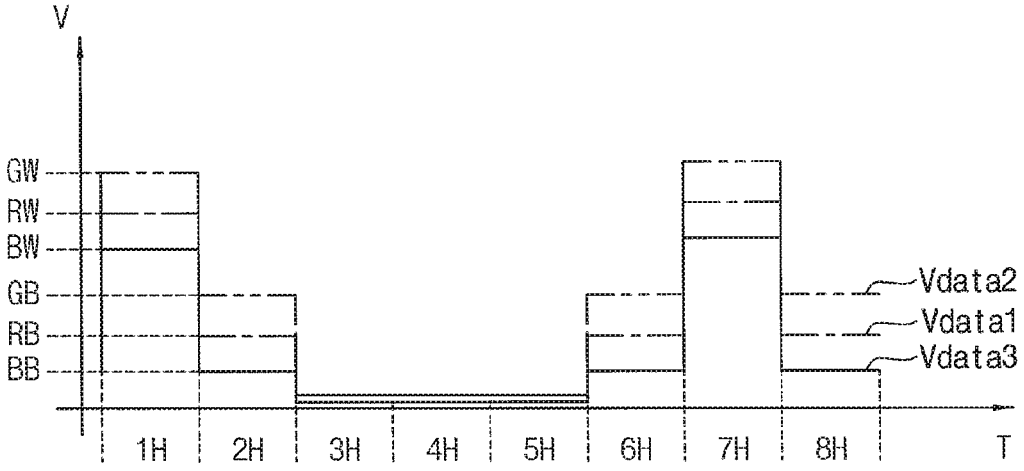

FIGS. 5A and 5B are a conceptual diagram and a waveform diagram illustrating a method of correcting a black-level of a black continuous pattern according to an exemplary embodiment of the inventive concept.

FIG. 5A shows the black continuous pattern BCON displayed on the display panel. For example, the black continuous pattern B_CON continuously displays a black-grayscale image BI on a plurality of horizontal lines. As shown in FIG. 5A, the black continuous pattern B_CON includes a white-grayscale image WI displayed on the first horizontal line HL1, a black-grayscale image BI sequentially displayed on the second to sixth horizontal lines HL2 to HL6, and white-grayscale image WI displayed on the seventh horizontal line HL7.

The black continuous pattern B_CON has black-grayscale data corresponding to the second to sixth horizontal lines HL2 to HL6.

Referring to FIGS. 3 and 5A, when the input image data satisfy the black continuous pattern condition, the black-grayscale correcting circuit 300 corrects the black-grayscale data of the second horizontal line HL2 which is the first horizontal line and the sixth horizontal line HL6 which is the last horizontal line with respect to the second to sixth horizontal lines HL2 to HL6 to the reference color black-level based on the dispersion by the color. The black-grayscale correcting circuit 300 corrects the black-grayscale data of the third horizontal line HL3 to the fifth horizontal line HL5 to a black-level of about 0 V.

For example, referring to FIG. 5B, red pixels R are connected to a first data line DL1, green pixels G are connected to a second data line DL2, and blue pixels B are connected to the third data line DL3.

A red data voltage Vdata1 is applied to the first data line DL1, a green data voltage Vdata2 is applied to the second data line DL2, and the blue data voltage Vdata3 is applied to the third data line DL3.

Referring to the red data voltage Vdata1 applied to the first data line DL1 as shown in FIG. 5B, the red data voltage Vdata1 has a red white-grayscale level RW corresponding to the white grayscale data in the first horizontal line HL1. The red data voltage Vdata1 has the reference red black-level RB corresponding to the black-grayscale data in the second horizontal line HL2. The red data voltage Vdata1 has a black level of about 0 V in the third to fifth horizontal lines HL3 to HL5 having the black-grayscale data consecutive to the second horizontal line HL2. The red data voltage Vdata1 has a reference red black-level RB corresponding to the black-grayscale data in the sixth horizontal line HL6 before the seventh horizontal line HL7 with the white grayscale data. The red data voltage Vdata1 has a white-grayscale level RW corresponding to the white grayscale data in the eighth horizontal line HL8.

Referring to the green data voltage Vdata2 applied to the second data line DL2 as shown in FIG. 5B, the green data voltage Vdata2 has a green white-grayscale level GW corresponding to the white grayscale data in the first horizontal line HL1. The green data voltage Vdata2 has a reference green black-level GB corresponding to the black-grayscale data in the second horizontal line HL2. The green data voltage Vdata2 has a black level of about 0 V on the third to fifth horizontal lines HL3 to HL5 having the black-grayscale data consecutive to the second horizontal line HL2. The green data voltage Vdata2 has a reference green black-level GB corresponding to the black-grayscale data in the sixth horizontal line HL6 before the seventh horizontal line HL7 with the white grayscale data. The green data voltage Vdata2 has a green white-grayscale level GW corresponding to the white grayscale data in the eighth horizontal line HL8.

Referring to the blue data voltage Vdata3 applied to the third data line DL3 as shown in FIG. 5B, the blue data voltage Vdata3 has a blue white-grayscale level BW corresponding to the white grayscale data in the first horizontal line HL1. The blue data voltage Vdata3 has the reference blue black-level BB corresponding to the black-grayscale data in the second horizontal line HL2. The blue data voltage Vdata3 has a black level of about 0 V in the third to fifth horizontal lines HL3 to HL5 having the black-grayscale data consecutive to the second horizontal line HL2. The blue data voltage Vdata3 has a reference blue black-level BB corresponding to the black-grayscale data in the sixth horizontal line HL6 before the seventh horizontal line HL7 with the white grayscale data. The blue data voltage Vdata3 has a blue white-grayscale level BW corresponding to the white grayscale data in the eighth horizontal line HL8.

Figure 6A:
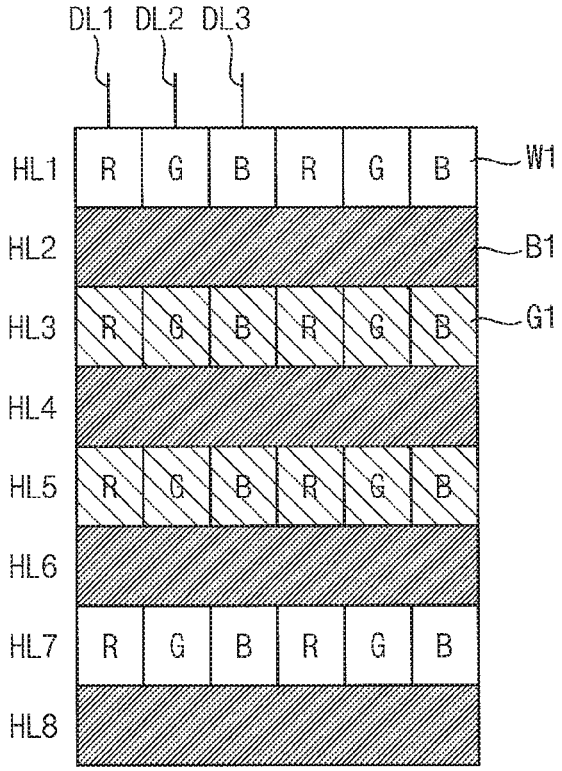
FIGS. 6A and 6B are a conceptual diagram and a waveform diagram illustrating a method of correcting a black-level of a normal image according to an exemplary embodiment of the inventive concept.
Figure 6B:
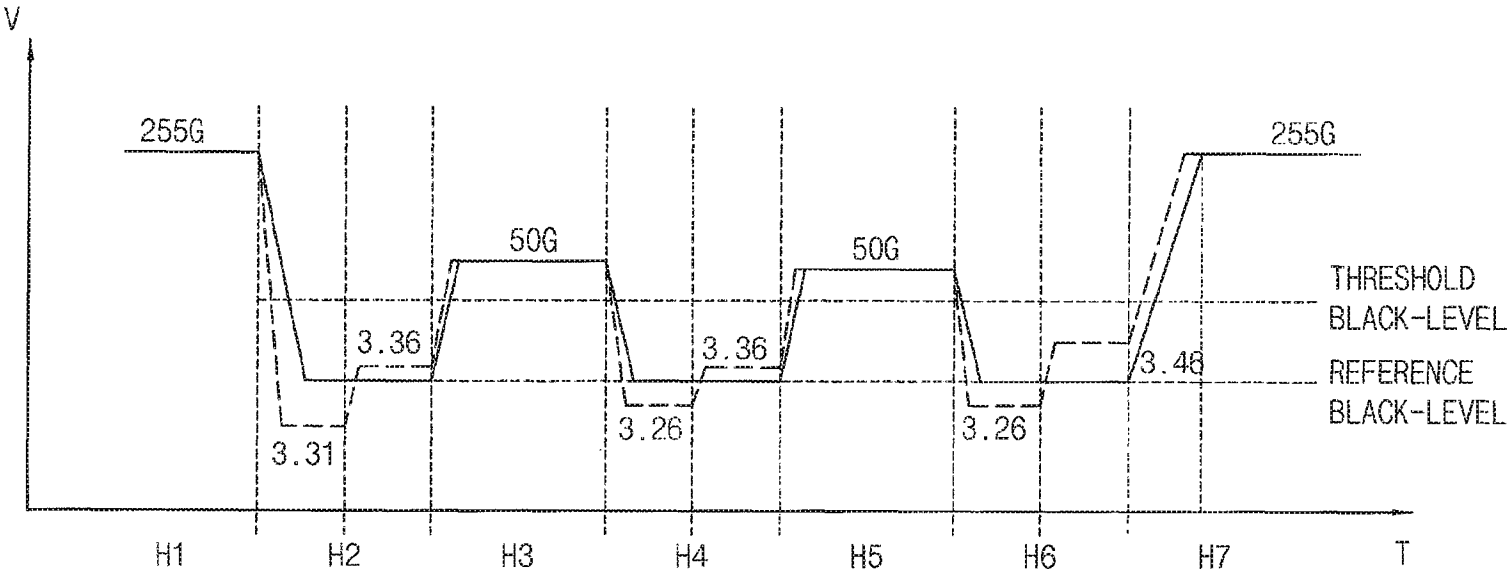

FIGS. 6A and 6B are a conceptual diagram and a waveform diagram illustrating a method of correcting a black-level of a normal image according to an exemplary embodiment of the inventive concept. For example, a normal image may be an image that differs from the images shown in FIG. 4A and FIG. 5A. In an embodiment, a normal image does not include alternating white and black lines, and does not include multiple consecutive black lines between a pair of white lines.

FIG. 6A shows a normal image NOR_I including a white-grayscale image WI, a middle-grayscale image GI and a black-grayscale image BI displayed on a display panel. For example, as shown in FIG. 6A. the normal image NOR_I includes a white-grayscale image WI displayed on the first horizontal line HL1, a black-grayscale image BI displayed on the second horizontal line HL2, a middle-grayscale image GI displayed on the third horizontal line HL3, a grayscale image BI displayed on the fourth horizontal line HL4, the middle-grayscale image GI displayed on the fifth horizontal line HL5, the black-grayscale image BI display on the sixth horizontal line HL6, the white-grayscale image WI displayed on the seventh horizontal line HL7, and the black-grayscale image BI displayed on the eighth horizontal line HL8.

For example, red pixels R are connected to a first data line DL1, green pixels G are connected to a second data line DL2, and blue pixels B are connected to the third data line DL3. A red data voltage Vdata1 is applied to the first data line DL1, a green data voltage Vdata2 is applied to the second data line DL2, and the blue data voltage Vdata3 is applied to the third data line DL3.

Hereinafter, a method of correcting the red black-level of the red black-grayscale data applied to the red pixel when the normal image shown in FIG. 6A is displayed in the central area of the display panel is described.

Referring to FIGS. 2, 3B and 6B, when the black-grayscale grayscale data D(n) of the second horizontal line HL2 is received, the black-grayscale correcting circuit 300 determines a condition corresponding to the color of the black-grayscale data D(n), the position of a pixel on the display panel, the grayscale data of the previous horizontal line, and the grayscale data of the next horizontal line.

The red black-gray-scale data D(n) of the second horizontal line HL2 is the red pixel data located in the central area of the display panel, the grayscale data D(n−1) of the previous horizontal line HL1 is 255-grayscale data 255G and the grayscale data D(n+1) of the next horizontal line HL3 is 50-grayscale data 50G.

The black-grayscale correcting circuit 300 determines a red black-gray level respectively corresponding to the grayscale data D(n−1) of the previous horizontal line and the grayscale data D(n+1) of the next horizontal line by using a first look-up table 331 corresponding to the central area shown in FIG. 3B.

The first red-black level of about 3.31 V corresponding to the 255-grayscale data 255G being the grayscale data D(n−1) of the previous horizontal line is determined using the first falling-color table FC_T1. The second red black-level of about 3.36 V corresponding to the 50-grayscale data 50G being the grayscale data D(n+1) of the next horizontal line is determined using the first rising-color table RC_T1.

The black-grayscale correcting circuit 300 determines the red black-grayscale data D(n) as the first red black-level of about 3.31 V and a second red black-level of about 3.36 V. During the second horizontal period H2 corresponding to the second horizontal line HL2, the red data voltage Vdata1 shown in FIG. 6*a* sequentially has the first red black-level of about 3.31 V and the second red black-level of about 3.36 V. In an exemplary embodiment, the red black-grayscale data D(n) has the first red black-level of about 3.31 V for a first half of the second horizontal period H2 and has the second red-black level of about 3.31 V for the second half of the second horizontal period H2.

Then, when the black-grayscale data D(n) of the fourth horizontal line HL4 is received, the black-grayscale correcting circuit 300 determines the red black-level respectively corresponding to the grayscale data D(n−1) of the previous horizontal line and the grayscale data D(n+1) of the next horizontal line by using the first look-up table 331.

The first red-black level of about 3.26 V corresponding to the 50-grayscale data 50G being the grayscale data D(n−1) of the previous horizontal line is determined using the first falling-color table FC_T1. The second red black-level of about 3.36 V corresponding to the 50-grayscale data 50G being the grayscale data D(n+1) of the next horizontal line is determined using the first rising-color table RC_T1.

The black-grayscale correcting circuit 300 determines the red black-grayscale data D(n) as the first red black-level of about 3.26 V and the second red black-level of about 3.36 V. During the fourth horizontal period H4 corresponding to the fourth horizontal line HL4, the red data voltage Vdata1 shown in FIG. 6A sequentially has the first red black-level of about 3.26 V and the second red black-level of about 3.36 V. In an exemplary embodiment, the red black-grayscale data D(n) has the first red black-level of about 3.26 V for a first half of the fourth horizontal period H4 and has the second red-black level of about 3.36 V for the second half of the fourth horizontal period H4.

Then, when the black-grayscale data D(n) of the sixth horizontal line HL6 is received, the black-grayscale correcting circuit 300 determines the red black-level respectively corresponding to the grayscale data D(n−1) of the previous horizontal line and the grayscale data D(n+1) of the next horizontal line by using the first look-up table 331.

The first red-black level of about 3.26 V corresponding to the 50-grayscale data 50G being the grayscale data D(n−1) of the previous horizontal line is determined using the first falling-color table FC_T1. The second red black-level of about 3.46 V corresponding to the 255-grayscale data 255G being the grayscale data D(n+1) of the next horizontal line is determined using the first rising-color table RC_T1.

The black-grayscale correcting circuit 300 determines the red black-grayscale data D(n) as the first red black-level of about 3.26 V and the second red black-level of about 3.46 V. During the sixth horizontal period H6 corresponding to the sixth horizontal line HL6, the red data voltage Vdata1 shown in FIG. 6A sequentially has the first red black-level of about 3.26 V and the second red black-level of about 3.46 V. In an exemplary embodiment, the red black-grayscale data D(n) has the first red black-level of about 3.26 V for a first half of the sixth horizontal period H6 and has the second red-black level of about 3.46 V for the second half of the sixth horizontal period H6.

Figure 7:
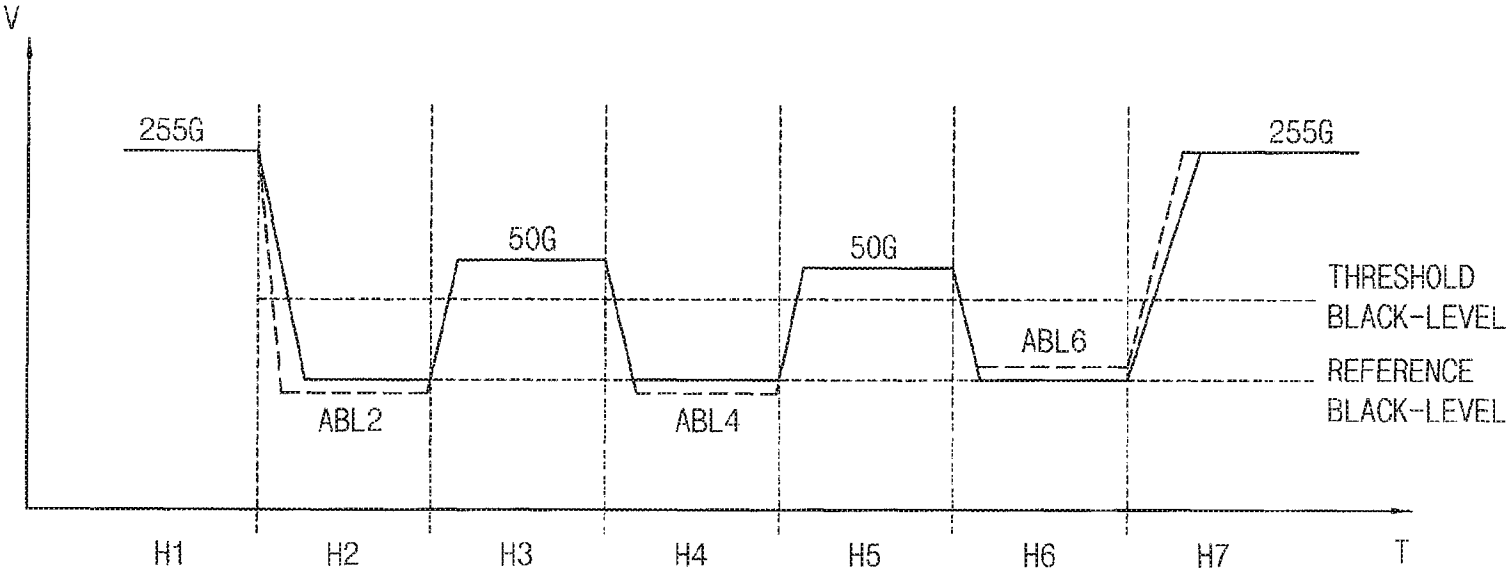
FIG. 7 is a waveform diagram illustrating a black-level correction method of a normal image according to an exemplary embodiment of the inventive concept.

FIG. 7 is a waveform diagram illustrating a black-level correction method of a normal image according to an exemplary embodiment of the inventive concept.

Referring to FIGS. 6A, 6B and 7, when the grayscale data D(n) of the second horizontal line HL2 is received, the black-grayscale correcting circuit 300 determines a first red black-level of about 3.31 V corresponding to the 255-grayscale data 255G which is the grayscale data D(n−1) of the previous horizontal line using the first falling-color table FC_T1. The black-grayscale correcting circuit 300 determines a second red black-level of about 3.36 V corresponding to the 50-grayscale data 50G which is the grayscale data D(n+1) of the next horizontal line.

The black-grayscale correcting circuit 300 calculates an average black-level of the first and second red black-levels. The black-grayscale correcting circuit 300 determines the average black-level ABL2 as a red black-level of the black-grayscale data D(n).

During the second horizontal period H2 corresponding to the second horizontal line HL2, the red data voltage Vdata1 shown in FIG. 7 has the average black-level ABL2.

Then, when the black-grayscale data D(n) of the fourth horizontal line HL4 is received, the black-grayscale correcting circuit 300 determines the first red black-level of about 3.26 V corresponding to the 50-grayscale data 50G which is the grayscale data D(n−1) of the previous horizontal line using the first falling-color table FC_T1. The black-grayscale correcting circuit 300 determines the second red black-level of about 3.36 V corresponding to the 50-grayscale data 50G which are the grayscale data D(n+1) of the next horizontal line.

The black-gray-scale correcting circuit 300 calculates an average black-level ABL4 of the first and second red black-levels of about 3.26 V and about 3.36 V to determine the average black-level ABL4 as the red black-level of the black-grayscale data D(n).

During the fourth horizontal period H4 corresponding to the fourth horizontal line HL4, the red data voltage Vdata1 shown in FIG. 7 has the average black-level ABL4.

Then, when the black-grayscale data D(n) of the sixth horizontal line HL6 is received, the black-grayscale correcting circuit 300 determines the first red black-level of about 3.26 V corresponding to the 50-grayscale data 50G which is the grayscale data D(n−1) of the previous horizontal line using the first falling-color table FC_T1. The black-grayscale correcting circuit 300 determines the second red black-level of about 3.46 V corresponding to the 255-grayscale data 255G which is the grayscale data D(n+1) of the next horizontal line.

The black-gray-scale correcting circuit 300 calculates an average black-level ABL6 of the first and second red black-levels about 3.26 V and about 3.46 V and determines the average black-level ABL6 as the red black-level of the black-grayscale data D(n).

During the sixth horizontal period H6 corresponding to the sixth horizontal line HL6, the red data voltage Vdata1 shown in FIG. 7 has the average black-level ABL6.

According to exemplary embodiments, depending on the conditions, the black-level of the black-grayscale data may be corrected differently to improve the luminance and the image quality.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of exemplary embodiments of the inventive concept and is not to be construed as limiting thereof. Although a few exemplary embodiments of the inventive concept have been described, many modifications are possible in the exemplary embodiments without materially departing from the inventive concept. Accordingly, all such modifications are intended to be included within the scope of the inventive concept.

What is claimed is:

1. A display device comprising:

a display panel including a plurality of data lines and a plurality of color pixels arranged into rows;

a black-grayscale correcting circuit correcting a black-level of black-grayscale data of input grayscale data to generate corrected image data, wherein the black-grayscale correcting circuit corrects the black-grayscale data of a given frame to be applied to a current one of the rows during a current horizontal period based on the input grayscale data of the given frame to be applied to a previous one of the rows that is adjacent and before the current row during a previous horizontal period and the input grayscale data of the given frame to be applied to a next one of the rows that is adjacent and after the current row during a next horizontal period; and a data driving circuit converts the corrected image data into data voltages and outputs the data voltages to the plurality of data lines.

2. The display device of claim 1, wherein when the input grayscale data includes a pattern in which non-black-grayscale data and the black-grayscale data alternate by a horizontal period, the black-grayscale correcting circuit differently corrects the black-level of the black-grayscale data according toa color of the pixels to receive the input grayscale data.

3. The display device of claim 1, wherein when the input grayscale data includes consecutive black-grayscale data in a plurality of horizontal periods, the black-grayscale correcting circuit corrects the black-level of the black-grayscale data to about 0 V.

4. The display device of claim 3, wherein a black-level of the black-grayscale data corresponding to first and last horizontal periods of the plurality of horizontal periods corresponding to the consecutive black-grayscale data is differently corrected according to a color of the pixels to receive the input grayscale data.

5. The display device of claim 1, wherein the black-grayscale correcting circuit corrects a black-level of the black-grayscale data according to an area of the display panel where a color pixel corresponding to the black-grayscale data is located.

6. The display device of claim 5, wherein when the grayscale data of the previous horizontal period corresponding to the black-grayscale data is middle grayscale data with respect to a central area of the display panel, the black-grayscale correcting circuit corrects a black-level of the black-grayscale data to a black-level lower than a reference black-level.

7. The display device of claim 6, wherein when the grayscale data of the next horizontal period corresponding to the black-grayscale data is middle grayscale data with respect to a central area of the display panel, the black-grayscale correcting circuit corrects a black-level of the black-grayscale data to a black-level higher than the reference black-level.

8. The display device of claim 7, wherein the black-grayscale correcting circuit corrects a black level of the black-grayscale data by increasing or decreasing based on the black level of the central area with respect to a left area and a right area of the central area.

9. The display device of claim 7, wherein the black-grayscale correcting circuit sequentially corrects a black-level of the black-grayscale data to a first black-level determined by the grayscale data of the previous horizontal period and a second black-level determined by the grayscale data of the next horizontal period.

10. The display device of claim 7, wherein the black-grayscale correcting circuit corrects a black-level of the black-grayscale data to an average level of a first black-level determined by the grayscale data of the previous horizontal period and a second black-level determined by the grayscale data of the next horizontal period.

11. A method of driving a display device which comprises a display panel including a plurality of data lines and a plurality of color pixels arranged into rows, the method comprising:

correcting a black-level of black-grayscale data of input grayscale data to generate corrected image data, wherein the correcting corrects the black-grayscale data of a given frame to be applied to a current one of the rows during a current horizontal period based on the input grayscale data of the given frame to be applied to a previous one of the rows that is adjacent and before the current row during a previous horizontal period and the input grayscale data of the given frame to be applied to a next one of the rows that is adjacent and after the current row during a next horizontal period;

converting the corrected image data into data voltages; and outputting the data voltages to the plurality of data lines.

12. The method of claim 11, the correcting comprising:

differently correcting the black-level of the black-grayscale data according to a color of the pixels to receive the input grayscale data, when the input grayscale data includes a pattern in which a non-black-grayscale data and the black-grayscale data alternate by a horizontal period.

13. The method of claim 11, the correcting comprising:

correcting the black-level of the black-grayscale data to about 0 V, when the input grayscale data includes consecutive black-grayscale data in a plurality of horizontal periods.

14. The method of claim 13, wherein a black-level of the black-grayscale data corresponding to first and last horizontal periods of the plurality of horizontal periods corresponding to the consecutive black-grayscale data is differently corrected according to a color of the pixels to receive the input grayscale data.

15. The method of claim 11, the correcting comprising:

correcting a black-level of the black-grayscale data according to an area of the display panel where a color pixel corresponding to the black-grayscale data is located.

16. The method of claim 11, the correcting comprising:

correcting a black-level of the black-grayscale data to a black-level lower than a reference black-level, when the grayscale data of the previous horizontal period corresponding to the black-grayscale data is middle grayscale data with respect to a central area of the display panel.

17. The method of claim 16, the correcting comprising:

correcting a black-level of the black-grayscale data to a black-level higher than the reference black-level, when the grayscale data of the next horizontal period corresponding to the black-grayscale data is middle grayscale data with respect to a central area of the display panel.

18. The method of claim 17, the correcting further comprising:

correcting a black-level of the black-grayscale data by increasing or decreasing based on the black level of the central area with respect to a left area and a right area of the central area.

19. The method of claim 17, the correcting further comprising:

sequentially correcting a black-level of the black-grayscale data to a first black-level determined by the grayscale data of the previous horizontal period and a second black-level determined by the grayscale data of the next horizontal period.

20. The method of claim 17, the correcting further comprising:

correcting a black-level of the black-grayscale data to an average level of a first black-level determined by the grayscale data of the previous horizontal period and a second black-level determined by the grayscale data of the next horizontal period.

21. A display device comprising:

a display panel including a plurality of color pixels arranged into rows and columns, the color pixels comprising a column of red pixels connected to a first data line, a column of green pixels connected to a second data line, and a column of blue pixels connected to a third data lines;

a correction circuit corrects black-grayscale data of input grayscale data for the red pixels to a red black-level perceivable as black during a horizontal period, corrects black-grayscale data of the input grayscale data for the green pixels to a green black-level perceivable as black during the same horizontal period, and corrects black-grayscale data of the input grayscale data for the blue pixels to a blue black-level perceivable as black during the same horizontal period, to generate corrected image data; and a data driving circuit converts the corrected image data into data voltages for output to the data lines, wherein the red black-level is between the green and blue black-levels.

22. The display device of claim 21, wherein the correction circuit performs the correction when the input grayscale data includes a pattern in which non-black-grayscale data and the black-grayscale data alternate by a horizontal period.

23. The display device of claim 21, wherein the non-black-grayscale data is white grayscale data.

* * * * *